US009421752B2

(12) United States Patent
Kamoda

(10) Patent No.: US 9,421,752 B2
(45) Date of Patent: Aug. 23, 2016

(54) NUMBERING AND IMPRINTING MACHINE AND PRINTING PRESS UTILIZING THE SAME

(71) Applicant: KOMORI CORPORATION, Tokyo (JP)

(72) Inventor: Hiroyoshi Kamoda, Tsukuba (JP)

(73) Assignee: KOMORI CORPORATION, Tokyo (JP)

( * ) Notice: Subject to any disclaimer, the term of this patent is extended or adjusted under 35 U.S.C. 154(b) by 0 days.

(21) Appl. No.: 14/591,089

(22) Filed: Jan. 7, 2015

(65) Prior Publication Data

US 2015/0210061 A1 Jul. 30, 2015

(30) Foreign Application Priority Data

Jan. 24, 2014 (JP) ..... 2014-010887

(51) Int. Cl.

| | |
|---|---|
| ***B41F 13/00*** | (2006.01) |
| ***B41F 7/06*** | (2006.01) |
| ***B41F 23/04*** | (2006.01) |
| ***B41F 7/02*** | (2006.01) |

(52) U.S. Cl.

CPC ..... *B41F 13/0032* (2013.01); *B41F 7/025* (2013.01); *B41F 7/06* (2013.01); *B41F 23/0453* (2013.01)

(58) Field of Classification Search

CPC ..... B41F 1/56; B41F 1/565; B41F 1/58; B41F 1/16; B41F 1/18; B41F 11/02; B41F 11/00; B41F 13/0032; B41F 3/86; B41K 3/102; B41N 1/22

See application file for complete search history.

(56) References Cited

U.S. PATENT DOCUMENTS

| | | | | |
|---|---|---|---|---|
| 984,372 | A | 2/1911 | Hollingsworth | |
| 3,782,277 | A | 1/1974 | Neal | |
| 4,848,265 | A * | 7/1989 | Komori | B41F 23/08 101/216 |
| 6,338,299 | B1 * | 1/2002 | Kamoda | B41F 7/025 101/231 |
| 6,675,707 | B1 * | 1/2004 | Heiler | B41F 23/08 101/216 |
| 6,718,908 | B1 * | 4/2004 | Bayer | B05C 1/0834 101/229 |
| 2002/0002916 | A1 * | 1/2002 | Sugiyama | B41F 11/00 101/142 |
| 2002/0035942 | A1 | 3/2002 | Reinhard et al. | |
| 2002/0038608 | A1 | 4/2002 | Reinhard et al. | |
| 2007/0119316 | A1 * | 5/2007 | Sugiyama | B41F 11/00 101/216 |
| 2008/0037401 | A1 * | 2/2008 | Kusaka | B41F 9/021 369/260 |
| 2013/0312625 | A1 * | 11/2013 | Kamoda | B41F 11/02 101/153 |
| 2014/0182465 | A1 * | 7/2014 | Kamoda | B41F 9/00 101/153 |

FOREIGN PATENT DOCUMENTS

| | | | |
|---|---|---|---|
| DE | 2139830 | A1 | 2/1973 |
| EP | 0976555 | A1 | 2/2000 |
| EP | 2599631 | A1 | 6/2013 |
| JP | 8-216369 | A | 8/1996 |
| JP | 2000-62134 | A | 2/2000 |
| WO | WO 99/41082 | A1 | 8/1999 |
| WO | WO 2011/145028 | A1 | 11/2011 |

* cited by examiner

*Primary Examiner* — David Banh

(74) *Attorney, Agent, or Firm* — Birch, Stewart, Kolasch & Birch, LLP

(57) ABSTRACT

A numbering and imprinting machine includes: a numbering printing unit for one surface including an impression cylinder and a numbering cylinder; a first numbering printing unit for the other surface including an impression cylinder and a numbering cylinder; a drying unit for numbering printing for one surface including a drying cylinder and a drying device; a second numbering printing unit for the other surface including an impression cylinder and a numbering cylinder; and a drying unit for numbering printing for the other surface including a transfer cylinder, a drying cylinder, and a drying device.

6 Claims, 1 Drawing Sheet

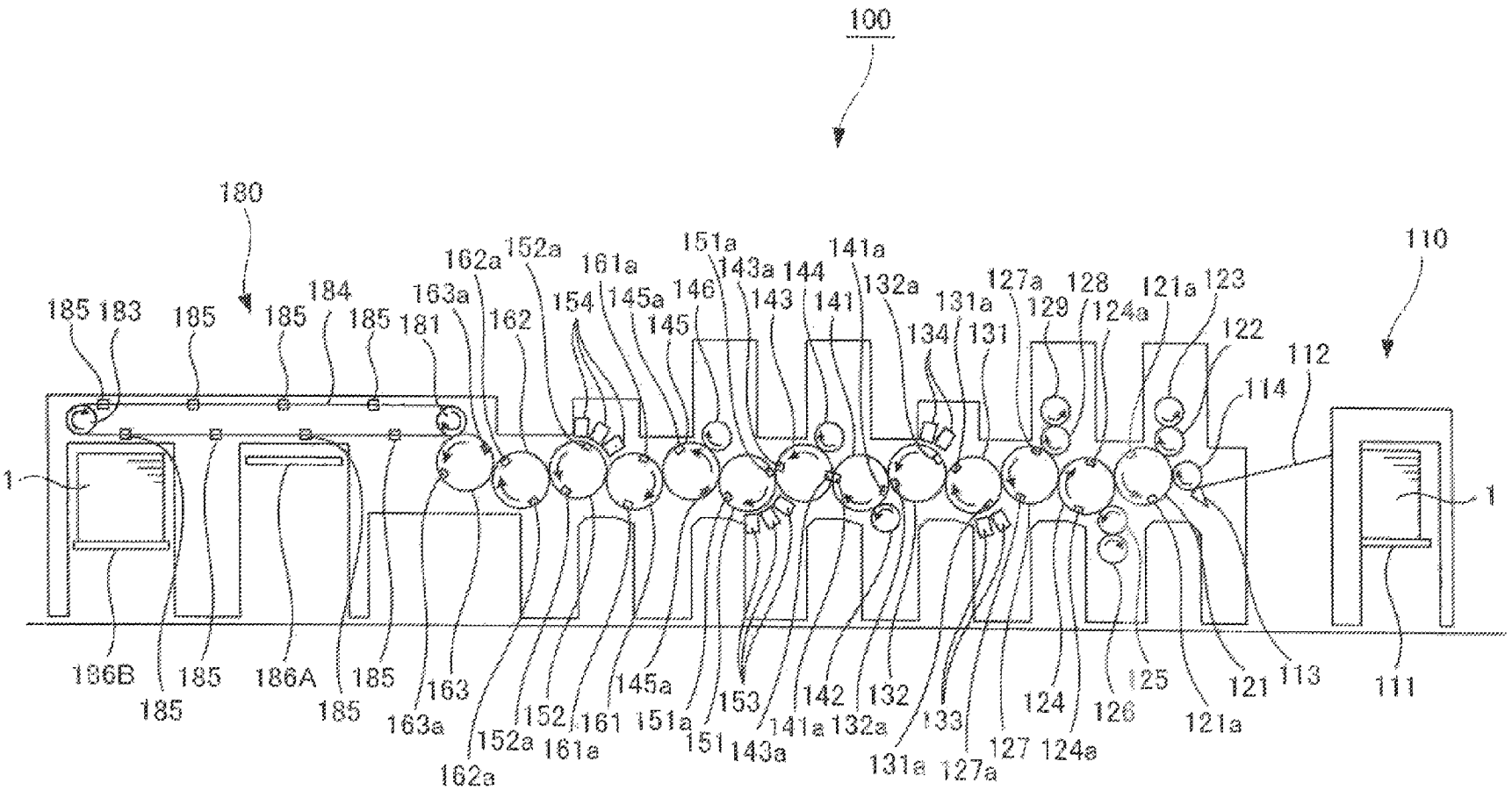
100
110
111
1
112
113
114
121
121a
122
123
124
124a
125
126
127
127a
128
129
131
131a
132
132a
133
134
141
141a
142
143
143a
144
145
145a
146
151
151a
152
152a
153
154
161
161a
162
162a
163
163a
180
181
183
184
185
186A
186B

NUMBERING AND IMPRINTING MACHINE AND PRINTING PRESS UTILIZING THE SAME

TECHNICAL FIELD

The present invention relates to a numbering and imprinting machine for performing numbering printing on a sheet and to a printing press utilizing the same.

BACKGROUND ART

As a conventional numbering and imprinting machine for performing numbering printing on a sheet, for example, there is one configured to print a first number on an outer surface (one surface) of a sheet by means of a numbering cylinder of a first numbering printing unit while a sheet is held on an impression cylinder of the first numbering printing unit, then to transfer the sheet via a transfer cylinder to an impression cylinder of a second numbering printing unit and support the sheet on the impression cylinder, and to print a second number on the outer surface (one surface) of the sheet by means of a numbering cylinder of the second numbering printing unit, such that the numbering and imprinting machine can print two numbers on the one surface of the sheet (see for example Patent Literature 1).

CITATION LIST

Patent Literature

{Patent Literature 1} Japanese Patent application Publication No. 2000-062134

{Patent Literature 2} Japanese Patent Application Publication No. 8-216369

SUMMARY OF INVENTION

Technical Problem

However, the conventional numbering and imprinting machine as described above is capable of printing two numbers on one surface of a sheet by passing the sheet therethrough once, but is incapable of printing numbers on both of one surface and the other surface of tire sheet by passing the sheet therethrough once. For this reason, when numbers are to be printed on one surface and the other surface of the sheet, it is necessary to first print a number on one surface of a sheet in the numbering printing press, and to then pass the sheet again through the numbering printing press to print a number on the other surface of the sheet. This is not only troublesome but may also lead to deterioration in registration accuracy between a number printed on one surface and a number printed on the other surface.

In view of the aforementioned problem, an object of the present invention is to provide a numbering and imprinting machine capable of easily printing numbers on both of one surface and another surface of a sheet with high accuracy and a printing press utilizing the same.

Solution to Problem

To solve the aforementioned problem, a first aspect of the present invention provides a numbering and imprinting machine for printing numbers on a sheet, comprising: a numbering printing unit for one surface including an impression cylinder for numbering printing for one surface configured to hold and transport the sheet, and a numbering cylinder for one surface disposed to be movable into contact with and away from the impression cylinder for numbering printing for one surface, and configured to perform numbering printing on a surface of the sheet on an outer side in a radial direction of the impression cylinder for numbering printing for one surface while the sheet is held on the impression cylinder for numbering printing for one surface; a first numbering printing unit for the other surface including a first impression cylinder for numbering printing for the other surface disposed in contact with the impression cylinder for numbering printing for one surface of the numbering printing unit for one surface at a position downstream of a contact position of the impression cylinder for numbering printing for one surface with the numbering cylinder for one surface in a sheet transport direction, and configured to receive the sheet from the impression cylinder for numbering printing for one surface and to hold and transport the sheet, and a first numbering cylinder for the other surface disposed to be movable into contact with and away from the first impression cylinder for numbering printing for the other surface. and configured to perform numbering printing on a surface of the sheet on an outer side in a radial direction of the first impression cylinder for numbering printing for the other surface while the sheet is held on the first impression cylinder for numbering printing for the other surface; a drying unit for numbering printing for one surface including a drying cylinder for numbering printing for one surface disposed in contact with the first impression cylinder for numbering printing for the other surface of the first numbering printing unit for the other surface at a position downstream of a contact positron of the first impression cylinder for numbering printing for the other surface with the first numbering cylinder for the other surface in the sheet transport direction, and configured to receive the sheet from the first impression cylinder for numbering printing for the other surface and to hold and transport the sheet, and drying means for numbering printing for one surface for drying a number printed on the surface of the sheet on an outer side in a radial direction of the drying cylinder for numbering printing for one surface while the sheet is held on the drying cylinder for numbering printing for one surface; and a second numbering printing unit for the other surface including a second impression cylinder for numbering printing for the other surface disposed in contact with the drying cylinder for numbering printing for one surface of the drying unit for numbering printing for one surface at a position downstream of a position where the drying means for numbering printing for one surface performs the drying, in the sheet transport direction, and configured to receive the sheet from the drying cylinder for numbering printing for one surface and to hold and transport the sheet, and a second numbering cylinder for the other surface disposed to be movable into contact with and away from the second impression cylinder for numbering printing for the other surface, and configured to perform numbering printing on the surface of the sheet on an outer side in a radial direction of the second impression cylinder for numbering printing for the other surface while the sheet is held on the second impression cylinder for numbering printing for the other surface.

In addition, a second aspect of the present invention provides the numbering and imprinting machine according to the first aspect, further comprising: an intermediate transport cylinder for numbering printing disposed in contact with the second impression cylinder for numbering printing for the other surface of the second numbering printing unit for the other surface at a position downstream of a contact position of the second impression cylinder for numbering printing for the other surface with the second numbering cylinder for the other surface in the sheet transport direction, and configured to receive the sheet from the second impression cylinder for numbering printing for the other surface and to hold and transport the sheet; and a drying unit for numbering printing for the other surface including a drying cylinder for numbering printing for the other surface disposed in contact with the intermediate transport cylinder for numbering printing, and configured to receive the sheet from the intermediate transport cylinder for numbering printing arid to hold and transport the sheet, and drying means for numbering printing for the other surface for drying a number printed on the surface of the sheet on an outer side in a radial direction of the drying cylinder for numbering printing for the other surface while the sheet is held on the drying cylinder for numbering printing for the other surface.

In addition, a third aspect of the present invention provides a printing press comprising: the numbering and imprinting machine according to the first or second aspect; and an offset printing machine disposed at a position upstream, of the impression cylinder for numbering printing for one surface of the numbering printing unit for one surface of the numbering and imprinting machine in she sheet transport direction, and configured to perform offset printing on the sheet.

In addition, a fourth aspect of the present invention provides the printing press according to the third aspect, in which the offset printing machine includes: an offset printing u a it for one surface including a n impression cylinder for offset printing for one surface configured to hold and transport the sheet, a blanket cylinder for one surface disposed in contact with the impress ion cylinder for offset printing for one surface, and a plate cylinder for one surface disposed in contact with the blanket cylinder for one surface; a first offset printing unit for the other surface including a first impression cylinder fox offset printing for the other surface disposed in contact with the impression cylinder for offset printing for one surface of the offset printing unit for one surface at a position downstream of a contact position of the impression cylinder for offset printing for one surface with the blanket cylinder for one surface in the sheet transport direction, and configured to receive the sheet from the impression cylinder for offset printing for one surface and to hold and transport the sheet, a first blanket cylinder for the other surface disposed in contact with the first impression cylinder for offset printing for the other surface, and a first plate cylinder for the other surface disposed in contact with the first blanket cylinder for the other surface; a drying unit for offset printing for one surface including a drying cylinder for offset printing for one surface disposed in contact with the first impression cylinder for offset printing for the other surface of the first offset printing unit for the other surface at a position downstream of a contact position of the first impression cylinder for offset printing for the other surface with the first blanket cylinder for the other surface in the sheet transport direction, and configured to receive the sheet from the first impression cylinder for offset printing for the other surface and to hold and transport the sheet, and drying means fox offset printing for one surface for drying an ink transferred on the surface of the sheet on an outer side in a radial direction of the drying cylinder for offset printing for one surface while the sheet is held on the drying cylinder for offset printing for one surface; and a drying unit for offset printing for the ether surface including a drying cylinder for offset printing for the other surface disposed in contact with the drying cylinder for offset printing for one surface of the drying unit for offset printing for one surface at a position downstream of a position where the drying means for offset printing for one surface performs the drying, in the sheet transport direction, and configured to receive the sheet from the impression cylinder for offset printing for one surface and to hold and transport the sheet, and drying means for offset printing for the other surface for drying an ink transferred on the surface of the sheet on an outer side in a radial direction of the drying cylinder for offset printing for the other surface while the sheet is held on the drying cylinder for offset printing for the other surface.

In addition, a fifth aspect of the present invention provides the printing press according to the fourth aspect, in which the offset printing machine includes a second offset printing unit for the other surface including a second impression cylinder for offset printing for the other surface disposed in contact with the impression cylinder for offset printing for one surface of the offset printing unit for one surface at a position upstream of a contact position of the impression cylinder for offset printing for one surface with the blanket cylinder for one surface in the sheet transport direction and downstream of a contact position of the impression cylinder for offset printing for one surface with the first impression cylinder for offset printing for the other surface of the first offset printing unit for the other surface in she sheet transport direction, and configured to hold the sheet and transport the sheet to the impression cylinder for offset printing for one surface, a second blanket cylinder for the other surface disposed in contact with the second impression cylinder for offset printing for the other surface at a position upstream of a contact position of the second impression cylinder for offset printing for the other surface with the impression cylinder for offset printing for one surface in the sheet transport direction, and a second plate cylinder for the other surface disposed in contact with the second blanket cylinder for the other surface.

In addition, a sixth aspect of the present invention provides the printing press according to the fourth or fifth aspect, in which the drying cylinder for offset printing for the other surface of the drying unit for offset printing for the otter surface of the offset printing machine is in contact with the impression cylinder for numbering printing for one surface of the numbering printing unit for one surface of the numbering and imprinting machine at a position upstream of a contact position of the impression cylinder for numbering printing for one surface with the numbering cylinder for one surface in the sheet transport direction and downstream of a contact position of the impression cylinder for numbering printing for one surface with the first impression cylinder for numbering printing for the other surface of the first numbering printing unit for the other surface in the sheet transport direction.

Moreover, a seventh aspect of the present invention provides a numbering printing method using the numbering and imprinting machine according to the first or second aspect, comprising: performing numbering printing on one surface of a sheet by means of the numbering printing unit for one surface but not performing numbering printing on the other surface of the sheet by means of the first numbering printing unit for the other surface, by moving the numbering cylinder for one surface of the numbering printing unit for one surface and the second numbering cylinder for the other surface of the second numbering printing unit for the other surface into contact with the impression cylinder for numbering printing for one surface and the second impression cylinder for numbering printing for the other surface, respectively, and by moving the first numbering cylinder for the other surface of the first numbering printing unit for the other surface away from the first impression cylinder for numbering printing for the other surface; drying the number on the one surface of the sheet by means of the drying unit for numbering printing for one surface; and thereafter performing numbering printing on the other surface of the sheet by means of the second numbering printing unit for the other surface, thereby performing numbering printing of one number on the one surface of the sheet and numbering printing of one number on the other surface of the sheet.

Advantageous Effects of Invention

The numbering and imprinting machine according to the present invention and the printing press utilizing the same are not only capable of performing numbering printing of two numbers on one surface (the other surface) of a sheet by passing the sheet therethrough only once, but also capable of performing numbering printing of one number on both surfaces (one surface and the other surface) of a sheet by passing the sheet therethrough only once. Accordingly, it is possible to significantly reduce deterioration in the registration accuracy between the numbering printing on one surface and the numbering printing on the other surface, and thus to easily perform numbering printing on both surfaces of a sheet with high accuracy.

Moreover, since the transfer of the sheet is performed by only the cylinders, it is possible to largely reduce deterioration in the registration accuracy during the transfer of the sheet, and thus to greatly suppress deterioration in the accuracy of numbering printing.

In addition, according to the numbering printing method of the present invention, when numbering printing is to be performed on both surfaces of a sheet, numbering printing is performed on one surface of the sheet by the numbering printing unit for one surface but numbering printing is not performed on the other surface of the sheet by the first numbering printing unit for the other surface, and after the number on the one surface of the sheet is dried by the drying unit for numbering printing for one surface, numbering printing is performed on the other s or face of the sheet by the second numbering printing unit for the other surface. Accordingly it is possible to prevent smear and the like from occurring even when numbers are printed on one surface and the other surface of the sheet at the same position in a direction perpendicular to the sheet face.

BRIEF DESCRIPTION OF DRAWING

FIG. 1 shows an overall schematic configuration diagram of a main embodiment of a printing press in which a numbering and imprinting machine according to the present invention is combined with an offset printing machine.

DESCRIPTION OF EMBODIMENTS

Although embodiments of a numbering and imprinting machine according to the present invention and a printing press utilizing the same will be described on the basis of the drawing, the present invention is not limited only to the following embodiments described on the basis of the drawing.

<Main Embodiment>

A main embodiment of a printing press in which a numbering and imprinting machine according to the present invention is combined with an offset printing machine will be described on the basis of FIG. 1.

As shown in FIG. 1, a sheet feeding device 110, which is sheet feeding means for feeding a paper sheet 1, which is a sheet, is presided with a sheet feeding tray 111 on which the paper sheets 1 to be fed are stacked. A base end-side of a feeder board 112 configured to feed the paper sheets 1 on the sheet feeding tray 111 one by one is connected to the sheet feeding device 110. A transfer cylinder 114 configured to hold a leading end-side of the paper sheet 1 and transport the paper sheet 1 is disposed on a front end-side of the feeder board 112. A swing arm shaft pregripper 113 configured to pass the paper sheets 1 on the feeder board 112 one by one to the transfer cylinder 114 is disposed between the front end-side of the feeder board 112 and the transfer cylinder 114.

A double-size impression cylinder 121, which is a second impression cylinder for offset printing for the other surface, having two gripping devices 121*a* arranged at equal intervals in a circumferential direction thereof, is in contact with the transfer cylinder 114. Each of the gripping devices 121*a* has a gripper configured to detachably grip and hold the leading end-side of the paper sheet 1. A blanket cylinder 122, which is a second blanket cylinder for the other surface, having a rubber blanket wound around a peripheral surface thereof, is in contact with the impression cylinder 121.

A plate cylinder 123, which is a second plate cylinder for the other surface, having a printing plate wound around a peripheral surface thereof, is in contact with the blanket cylinder 122. An ink supply device (not shown), which is second ink supply means for offset printing for the other surface for supplying ink to the plate cylinder 123, is disposed around the plate cylinder 123. In the embodiment, the impression cylinder 121, the blanket cylinder 122, the plate cylinder 123, the ink supply device, and the like as described above constitute a second offset printing unit for the other surface.

A double-size impression cylinder 124, which is an impression cylinder for offset printing for one surface, having two gripping devices 124*a* arranged at equal intervals in a circumferential direction thereof, is in contact with the impression cylinder 121 at a position downstream of a contact position of the impression cylinder 121 with the blanket cylinder 122 in a rotation direction of the impression cylinder 121 (transport direction of the paper sheet 1) and upstream of a contact position thereof with the transfer cylinder 114 in the rotation direction thereof (transport direction of the paper sheet 1). Each of the gripping devices 124*a* has a gripper configured to detachably grip and hold the leading end-side of the paper sheet 1. A blanket cylinder 125, which is a blanket cylinder for one surface, having a rubber blanket wound around a peripheral surface thereof, is in contact with the impression cylinder 124.

A plate cylinder 126, which is a plate cylinder for one surface, having a printing plate wound around a peripheral surface thereof, is in contact with the blanket cylinder 125. An ink supply device (not shown), which is ink supply means for offset printing for one surface, for supplying ink to the plate cylinder 126, is disposed around the plate cylinder 126. In the embodiment, the impression cylinder 124, the blanket cylinder 125, the plate cylinder 126, the ink supply device, and the like as described above constitute an offset printing unit for one surface.

A double-size impression cylinder 127, which is a first impression cylinder for offset printing for the other surface, having two gripping devices 127*a* arranged at equal intervals in a circumferential direction thereof, is in contact with the impression cylinder 124 at a position downstream of a contact position of the impression cylinder 124 with the blanket cylinder 125 in a rotation direction of the impression cylinder 124 (transport direction of the paper sheet 1) and upstream of a contact position thereof with the impression cylinder 121 in the rotation direction thereof (transport direction of the paper sheet 1). Each of the gripping devices 127*a* has a gripper configured to detachable grip and hold the leading end-side of the paper sheet 1. A blanket cylinder 128, which is a first blanket cylinder for the other surface, having a rubber blanket wound around a peripheral surface thereof, is in contact with the impression cylinder 127.

A plate cylinder 129, which is a first plate cylinder for the other surface, having a printing plate wound around a peripheral surface thereof, is in contact with the blanket cylinder 128. An ink supply device (not shown), which is first ink supply means for offset printing for the other surface for supplying ink to the plate cylinder 129, is disposed around the place cylinder 129. In the embodiment, the impression cylinder 127, the blanket cylinder 128, the plate cylinder 129, the ink supply device, and the like as described above constitute a first offset printing unit for the other surface.

A double-size drying cylinder 131, which is a drying cylinder for offset printing for one surface, having two gripping devices 131*a* arranged at equal intervals in a circumferential direction thereof, is in contact with the impression cylinder 127 at a position downstream of a contact position of the impression cylinder 127 with the blanket cylinder 128 in a rotation direction of the impression cylinder 127 (transport direction of the paper sheet 1) and upstream of a contact position thereof with the impression cylinder 124 in the rotation correction thereof (transport direction of the paper sheet 1). Each of the gripping devices 131*a* has a gripper configured to detachably grip and hold the leading end-side of the paper sheet 1.

A double-size drying cylinder 132, which is a drying cylinder for offset printing for the other surface, having two gripping devices 132*a* arranged at equal intervals in a circumferential direction thereof, is in contact with the drying cylinder 131. Each of the gripping devices 132*a* has a gripper configured to detachably grip and hold the leading end-side of the paper sheet 1.

A double-size impression cylinder 141, which is an impression cylinder for numbering printing for one surface, having two gripping devices 141*a* arranged at equal intervals in a circumferential direction thereof, is in contact with the drying cylinder 132. Each of the gripping devices 141*a* has a gripper configured to detachable grip and hold the leading end-side of the paper sheet 1. A numbering cylinder 142, which is a numbering cylinder for one surface, is in contact with the impression cylinder 141. The numbering cylinder 142 is configured to perform numbering printing on a surface (one surface) of the paper sheet 1 on an outer side in a radial direction of the impression cylinder 141 while the paper sheet 1 is held on the impression cylinder 141.

A sheet guide, which is not shown (see, for example, Patent Literature 2 described above), is disposed on the impression cylinder 141 at a position downstream of a contact position of the impression cylinder 141 with the drying cylinder 132 in a rotation direction of the impression cylinder 141 (transport direction of the paper sheet 1) and upstream of a contact position thereof with the numbering cylinder 142 in the rotation direction thereof (transport direction of the paper sheet 1). The sheet guide is configured to press and stabilize the paper sheet 1 against an outer peripheral surface of the impression cylinder 141 while the paper sheet 1 is held and transported on the impression cylinder 141. In the embodiment, the impression cylinder 141, the numbering cylinder 142, the sheet guide, and the like as described above constitute a numbering printing unit for one surface.

A double-size impression cylinder 143, which is a first impression cylinder for numbering printing for the other surface, having two gripping devices 143*a* arranged at equal intervals in a circumferential direction thereof, is in contact with the impression cylinder 14 1 at a position downstream of a contact position of the impression cylinder 141 with the numbering cylinder 142 in a rotation direction of the impression cylinder 141 (transport direction of the paper sheet 1) and upstream of a contact position thereof with the drying cylinder 132 in the rotation direction thereof (transport direction of the paper sheet 1). Each of the gripping devices 143*a* has a gripper configured so detachably grip and hold the leading end-side of the paper sheet 1. A numbering cylinder 144, which is a first numbering cylinder for the other surface, is in contact with the impression cylinder 143. The numbering cylinder 144 is configured to perform numbering printing on a surface (the other surface) of the paper sheet 1 on an outer side in a radial direction of the impression cylinder 143 while the paper sheet 1 is held on the impression cylinder 143.

A sheet guide, which is not shown (see, for example, Patent Literature 2 described above), is disposed on the impression cylinder 143 at a position downstream of a contact position of the impression cylinder 143 with the impression cylinder 141 in a rotation direction of the impression cylinder 143 (transport direction of the paper sheet 1) and upstream of a contact position thereof with the numbering cylinder 144 in the rotation direction thereof (transport direction of the paper sheet 1). The sheet guide is configured to press and stabilize the paper sheet 1 against an outer peripheral surface of the impression cylinder 143 while the paper sheet 1 is held and transported on the impression cylinder 143. In the embodiment, the impression cylinder 143, the numbering cylinder 144, the sheet guide, and the like as described above constitute a first numbering printing unit for the other surface.

A double-size drying cylinder 151, which is a drying cylinder for numbering printing for one surface, having two gripping devices 151*a* arranged at equal intervals in a circumferential direction thereof, is in contact with the impression cylinder 143 at a position downstream of a contact position of the impression cylinder 143 with the numbering cylinder 144 in a rotation direction of the impression cylinder 143 (transport direction of the paper sheet 1) and upstream of a contact position thereof with the impression cylinder 141 in the rotation direction thereof (transport direction of the paper sheet 1). Each of the gripping devices 151*a* has a gripper configured to detachably grip and hold the leading end-side of the paper sheet 1.

A double-size impression cylinder 145, which is a second impression cylinder for numbering printing for the other surface, having two gripping devices 145*a* arranged at equal intervals in a circumferential direction thereof, is in contact with the drying cylinder 151. Each of the gripping devices 145*a* has a gripper configured to detachably grip and hold the leading end-side of the paper sheet 1. A numbering cylinder 146, which is a second numbering cylinder for the other surface, is in contact with the impression cylinder 145. The numbering cylinder 146 is configured to perform numbering printing on a surface of the paper sheet 1 on an outer side in a radial direction of the impression cylinder 145 while the paper sheet 1 is held on the impression cylinder 145.

A sheet guide, which is not shown (see, for example, Patent Literature 2 described above), is disposed on the impression cylinder 145 at a position downstream of a contact position of the impression cylinder 145 with the drying cylinder 151 in a rotation direction of the impression cylinder 145 (transport direction of the paper sheet 1) and upstream of a contact position thereof with the numbering cylinder 146 in the rotation direction thereof (transport direction of the paper sheet 1). The sheet guide is configured to press and stabilize the paper sheet 1 against an outer peripheral surface of the impression cylinder 145 while the paper sheet 1 is held and transported on the impression cylinder 145. In the embodiment, the impression cylinder 145, the numbering cylinder 146, the sheet guide, and the like as described above constitute a second numbering printing unit for the other surface.

A double-size transfer cylinder 161, which is an intermediate transport cylinder for numbering printing, having two gripping devices 161*a* arranged at equal intervals in a circumferential direction thereof, is in contact with the impression cylinder 145 at a position downstream of a contact position of the impression cylinder 145 with the numbering cylinder 146 in a rotation direction of the impression cylinder 145 (transport direction of the paper sheet 1) and upstream of a contact position thereof with the drying cylinder 151 in the rotation direction thereof (transport direction of the paper sheet 1). Each of the gripping devices 161*a* has a gripper configured to detachably grip and hold the leading end-side of the paper sheet 1. A double-size drying cylinder 152, which is a drying cylinder for numbering printing for the other surface, having two gripping devices 152*a* arranged at equal intervals in a circumferential direction thereof, is in contact with the transfer cylinder 161. Each of the gripping devices 152*a* has a gripper configured to detachable grip and hold the leading end-side of the paper sheet 1.

A double-size transfer cylinder 162, which is a transport cylinder, having two gripping devices 162*a* arranged at equal intervals in a circumferential direction thereof, is in contact with the drying cylinder 152. Each of the gripping devices 162*a* has a gripper configured to detachably grip and hold the leading end-side of the paper sheet 1. A double-size transfer cylinder 163, which is a transport cylinder, having two gripping devices 163*a* arranged at equal intervals in a circumferential direction thereof, is in contact with the transfer cylinder 162. Each of the gripping devices 162*a* has a gripper configured to detachably grip and hold the leading end-side of the paper sheet 1.

Moreover, drying devices 133, which are drying means for offset printing for one surface, are disposed around the drying cylinder 131 at positions downstream of a contact position of the drying cylinder 131 with, the impression cylinder 127 in a rotation direction of the drying cylinder 131 (transport direction of the paper sheet 1) and upstream of a contact position thereof with the drying cylinder 132 in the rotation direction thereof (transport direction of the paper sheet 1). The drying devices 133 are configured to dry (cure) the ink transferred onto the surface (one surface) of the paper sheet 1 on an outer side in a radial direction of the drying cylinder 131 by using heat (ultraviolet (UV) ray) while the paper sheet 1 is held and transported on the drying cylinder 131. In the embodiment, the drying cylinder 131, the drying devices 133, and the like as described above constitute a drying unit for offset printing for one surface.

Drying devices 134, which are drying means for offset printing for the other surface, are disposed around the drying cylinder 132 at positions downstream of a contact position of the drying cylinder 132 with the drying cylinder 131 in a rotation direction of the drying cylinder 132 (transport direction of the paper sheet 1) and upstream of a contact position thereof with the impression cylinder 141 in the rotation direction thereof (transport direction of the paper sheet 1). The drying devices 134 are configured to dry (cure) the ink transferred onto the surface (the other surface) of the paper sheet 1 on an outer side in a radial direction of the drying cylinder 132 by using heat (ultraviolet (UV) ray) while the paper sheet 1 is held and transported on the drying cylinder 132. In the embodiment, the drying cylinder 132, the drying devices 134, and the like as described above constitute a drying unit for offset printing for the other surface.

Drying devices 153, which are drying means for numbering printing for one surface, are disposed around the drying cylinder 151 at positions downstream of a contact position of the drying cylinder 151 with the impression cylinder 142 in a rotation direction of the drying cylinder 151 (transport direction of the paper sheet 1) and upstream of a contact position thereof with the impression cylinder 113 in the rotation direction thereof (transport direction of the paper sheet 1). The drying devices 153 are configured to dry a number printed on tins surface (one surface) of the paper sheet 1 on an outer side in a radial direction of the drying cylinder 151 while the paper sheet 1, is held and transported on the drying cylinder 151. In the embodiment, the drying cylinder 151, the drying devices 153, and the like as described above constitute a drying unit for numbering printing for one surface.

Drying devices 154, which are drying means for numbering printing for the other surface, are disposed around the drying cylinder 152 at positions downstream of a contact position of the drying cylinder 152 with the transfer cylinder 161 in a rotation direction of the drying cylinder 152 (transport direction of the paper sheet 1) and upstream of a contact position thereof with the transfer cylinder 162 in the rotation direction thereof (transport direction of the paper sheet 1). The drying devices 154 are configured to dry a number printed on the surface ( the other surface) of the paper sheet 1 on an outer side in a radial direction of the drying cylinder 152 while the paper sheet 1 is held and transported on the drying cylinder 152. In the embodiment, the drying cylinder 152, the drying devices 154, and the like as described above constitute a drying unit for numbering printing for the other surface.

A delivery cylinder 181 of a delivery device 180, which is sheet discharging means for discharging the printed paper sheet 1, is in contact with the transfer cylinder 163. A sprocket, which is not shown, is coaxially provided to the delivery cylinder 181. An endless delivery chain 184 is wound around the sprocket. The delivery chain 184 is wound around a sprocket 183 disposed away from the aforementioned sprocket. The delivery chain 134 is thus capable of traveling between these sprockets in accordance with rotations of the sprockets.

A plurality of gripper bars 185 are attached to the delivery chain 184 at predetermined intervals in a longitudinal direction of the delivery chain 184. Each of the gripper bars 185 includes a gripping device having a gripper configured to detachable grip and hold the leading end-side of the paper sheet 1. A plurality of delivery trays 186A and 186B for piling the printed paper sheets 1 are disposed below the delivery chain 184 along a traveling direction of the delivery chain 184.

Moreover, each of the blanket cylinders 122, 125, and 128 is supported to be movable into contact with and away from the corresponding impression cylinder 121, 124, or 127 and the corresponding plate cylinder 123, 125, or 129. Each of the numbering cylinders 142, 144, and 146 is supported to be movable into contact with and away from the corresponding impression cylinder 141, 143, or 145.

In the embodiment as described above, the offset printing unit for one surface, the first offset printing unit for the other surface, the second offset printing unit for the other surface, the drying unit for offset printing for one surface, the drying unit for offset printing for the other surface, and the like constitute the offset printing machine; the numbering printing unit for one surface, the first numbering printing unit for the other surface, the second numbering printing unit for the other surface, the drying unit for numbering printing for one surface, the drying unit for numbering printing for the other surface, one transfer cylinder 161, and the like constitute the numbering and imprinting machine; and the offset printing machine, the numbering and imprinting machine, the sheet feeding device 110, the delivery device 180, the transfer cylinders 162 and 163, and the like constitute the printing press 100.

Next, an operation of the printing press 100 according to the embodiment will be described.

For example, when offset printing of two types (two colors) and numbering printing of two numbers are performed on only one surface of the paper sheet 1, the blanket cylinders 122 and 128 of the first and second offset printing units for the other surface are positioned such that the blanket cylinders 122 and 128 are moved into contact with the impression cylinders 121 and 127 and the plate cylinders 123 and 129 while the blanket cylinder 125 of the offset printing unit for one surface is positioned such that the blanket cylinder 125 is moved away from the impression cylinder 124 and the plate cylinder 126. Moreover, the numbering cylinders 144 and 146 of the first and second numbering printing units for the other surface are positioned such that the numbering cylinders 144 and 146 are moved into contact with the impression cylinders 143 and 145 while the numbering cylinder 142 of the numbering printing unit for one surface is positioned such that the numbering cylinder 142 is moved away from the impression cylinder 141. In addition, only the drying devices 134 and 154 of the drying unit for offset printing for the other surface and the drying unit for numbering printing for the other surface are actuated while the drying devices 133 and 153 of the drying unit for offset printing for one surface and the drying unit for numbering printing for one surface are not actuated.

Then, when the sheet feeding device 110 and the like are actuated to feed the paper sheets 1 on the sheet feeding tray 111 one by one onto the feeder board 112, and the swing arm shaft pregripper 113 transfers the papers sheets 1 one by one to the transfer cylinder 114. The leading end-side of the paper sheet 1 thus transferred to the transfer cylinder 114 is then gripped by the gripping device 121*a* of the impression cylinder 121, so that the paper sheet 1 is held and transported on the impression cylinder 121.

The paper sheet 1 held on the impression cylinder 121 passes through the contact position of the impression cylinder 121 with the blanket cylinder 122. The ink (of the first color) supplied from the ink supply device onto the printing plate of the plate cylinder 123 and transferred onto the blanket cylinder 122 is thus transferred onto the surface (the other surface) of the paper sheet 1 on the outer side in the radial direction of the impression cylinder 121. The leading end-side of the paper sheet 1 is then gripped by the gripping device 124*a* of the impression cylinder 124, so that the paper sheet 1 is held and transported on the impression cylinder 124.

Since the blanket cylinder 125 is away from the impression cylinder 124, the paper sheet 1 held on the impression cylinder 124 is transported as it is with no ink being transferred to the surface (one surface) of the paper sheet 1 on the outer side in the radial direction of the impression cylinder 124. The leading end-side of the paper sheet 1 is then gripped by the gripping device 127*a* of the impression cylinder 127, so that the paper sheet 1 is held and transported on the impression cylinder 127.

The paper sheet 1 held on the impression cylinder 127 passes through the contact position of the impression cylinder 127 with the blanket cylinder 128. The ink (of the second color) supplied from the ink supply device onto the printing plate of the plate cylinder 129 and transferred onto the blanket cylinder 128 is thus transferred onto the surface (the other surface) of the paper sheet 1 on the outer side in the radial direction of the impression cylinder 121, The leading end-side of the paper sheet 1 is then gripped by the gripping device 131*a* of the drying cylinder 131, so that the paper sheet 1 is held and transported on the drying cylinder 131.

The paper sheet 1 held on the drying cylinder 131 is transported, and the leading end-side thereof is then gripped by the gripping device 132*a* of the drying cylinder 132, so that the paper sheet 1 is held and transported on the drying cylinder 132.

When the paper sheet 1 is held on the drying cylinder 132, the ink transferred onto the surface (the other surface) of the paper sheet 1 on the outer side in the radial direction of the drying cylinder 132 is dried by the drying devices 134. The leading end-side of the paper sheet 1 is then gripped by the gripping device 141*a* of the impression cylinder 141, so that the paper sheet 1 is held and transported on the impression cylinder 141.

Since the numbering cylinder 142 is away from the impression cylinder 141, the paper sheet 1 held on the impression cylinder 141 is transported as it is with no numbering printing being performed on the surface (one surface) of the paper sheet 1 on the outer side in the radial direction of the impression cylinder 141. The leading end-side of the paper sheet 1 is then gripped by the gripping device 143*a* of the impression cylinder 143, so that the paper sheet 1 is held and transported on the impression cylinder 143.

The paper sheet 1 held on the impression cylinder 143 passes through the contact position of the impression cylinder 143 with the numbering cylinder 144, so that the number (first number) of the numbering cylinder 144 is printed on the surface (the other surface) of the paper sheet 1 on the outer side in the radial direction of the impression cylinder 143 while the paper sheet 1 is pressed against the impression cylinder 143 by the sheet guide. At this time, since the inks (of the first and second colors) offset-printed on the paper sheet 1 have been dried by the drying devices 134, the inks do not adhere to the sheet guide.

After the numbering printing is performed on the paper sheet 1 on the impression cylinder 143, the leading end-side of the paper sheet 1 is then gripped by the gripping device 151*a* of the drying cylinder 151, so that the paper sheet 1 is held and transported on the drying cylinder 151. The paper sheet 1 held on the drying cylinder 151 is transported, and the leading end-side of the paper sheet 1 is then gripped by the gripping device 145*a* of the impression cylinder 145, so that the paper sheet 1 is held and transported on the impression cylinder 145.

The paper sheet 1 held on the impression cylinder 145 passes through the contact position of the impression cylinder 145 with the numbering cylinder 146, so that the number (the second number) of the numbering cylinder 146 is printed on the surface (the other surface) of the paper sheet 1 on the outer side in the radial direction of the impression cylinder 145 while the paper sheet 1 is pressed against the impression cylinder 145 by the sheet guide. At this time, since the inks (of the first and second colors) offset-printed on the paper sheet 1 have been dried by the drying devices 134, the inks do not adhere to the sheet guide.

After the numbering printing is performed on the paper sheet 1 on the impression cylinder 145, the leading end-side of the paper sheet 1 is then gripped by the gripping device 161*a* of the transfer cylinder 161, so that the paper sheet 1 is held and transported on the transfer cylinder 161. The paper sheet 1 held on the transfer cylinder 161 is transported, and the leading end-side of the paper sheet 1 is then gripped by the gripping device 152*a* of the drying cylinder 152, so that the paper sheet 1 is held and transported on the drying cylinder 152.

When the paper sheet 1 is held on the drying cylinder 152, the numbers (first and second numbers) printed on the surface (the other surface) of the paper sheet 1 on the outer side in the radial direction of the drying cylinder 152 are dried by the drying devices 154. The leading end-side of the paper sheet 1 is then gripped by the gripping device 162*a* of the transfer cylinder 162, so that the paper sheet 1 is held and transported on the transfer cylinder 162.

The paper sheet 1 held on the transfer cylinder 162 is transported, and the leading end-side of the paper sheet 1 is then gripped by the gripping devices 163*a* of the transfer cylinder 163, so that the paper sheet 1 is held and transported on the transfer cylinder 163.

The leading end-side of the paper sheet 1 held on the transfer cylinder 163 is then gripped by the gripper bar 185 of the delivery chain 184 through the delivery cylinder 181 of the delivery device 180. The paper sheet 1 is then transported in accordance with the traveling of the delivery chain 184, and discharged and piled on the delivery tray 186A or 186B.

As a result, offset printing of two types (two colors) and numbering printing of two numbers are performed on only one surface (the other surface) of the paper sheet 1.

On the other hand, when offset printing of one type (one color) and numbering printing of one number are performed on each of both surfaces of the paper sheet 1, the blanket cylinders 122 and 125 of the offset printing unit for one surface and the second offset printing unit for the other surface are positioned such that the blanket cylinders 122 and 125 are moved into contact with the impression cylinders 121 and 124 and the plate cylinders 123 and 126 while the blanket cylinder 128 of the first offset printing an it for the other surface is positioned such chat the blanket cylinder 128 is moved away from the impression cylinder 127 and the plate cylinder 129. Moreover, the numbering cylinders 142 and 126 of she numbering printing unit for one surface and the second numbering printing unit for the other surface are positioned such that the numbering cylinders 142 and 146 are moved into contact with the impression cylinders 141 and 145 while the numbering cylinder 144 of the first numbering printing unit for the other surface is positioned such that the numbering cylinder 144 is moved away from the impression cylinder 143, In addition, the drying devices 133, 134, 153, and 154 of all the drying units are actuated.

Then, in the same manner as described above, the sheet feeding device 110 and the like are actuated to feed the paper sheets 1 on the sheet feeding tray 111 one by one onto the feeder board 112, and the swing arm shaft pregripper 113 transfers the paper sheets 1 one by one to the transfer cylinder 114. The paper sheet 1 is then transferred to the impression cylinder 121 through the transfer cylinder 114. In the same manner as described above, the paper sheet 1 held on the impression cylinder 121 passes through the contact position of the impression cylinder 121 with the blanket cylinder 122. The ink (for the other surface) supplied from the ink supply device onto the printing plate of the plate cylinder 123 and transferred onto the blanket cylinder 122 is thus transferred onto the surface (the other surface) of the paper sheet 1 on the outer side in the radial direction of the impression cylinder 121. The leading end-side of the paper sheet 1 is then gripped by the gripping device 124*a* of the impression cylinder 124, so that the paper sheet 1 is held and transported on the impression cylinder 124.

The paper sheet 1 held on the impression cylinder 124 passes through the contact position of the impression cylinder 124 with the blanket cylinder 125. The ink (for one surface) supplied from the ink supply device onto the printing plate of the plate cylinder 126 and transferred onto the blanket cylinder 125 is thus transferred onto the surface (one surface) of the paper sheet 1 on the outer side in the radial direction of the impression cylinder 124. The leading end-side of the paper sheet 1 is then gripped by the gripping devices 127*a* of the impression cylinder 127, so that the paper sheet 1 is held and transported on the impression, cylinder 127.

Since the blanket cylinder 128 is away from the impression cylinder 127, the paper sheet 1 held on the impression cylinder 127 is transported as it is with no ink being transferred onto the surface (the other surface) of the paper sheet 1 on the outer side in the radial direction of the impression cylinder 127. The leading end-side of the paper sheet 1 is then gripped by the gripping devices 131*a* of the drying cylinder 131, so that the paper sheet 1 is held and transported on the drying cylinder 131.

When the paper sheet 1 is held on the drying cylinder 131, the ink (for one surface) transferred onto the surface (one surface) of the paper sheet 1 on the outer side in the radial direction of the drying cylinder 131 is dried by the drying devices 133. The leading end-side of the paper sheet 1 is then gripped by the gripping devices 132*a* of the drying cylinder 132, so that the paper sheet 1 is held and transported on she drying cylinder 132.

When the paper sheet 1 is held on the drying cylinder 132, the ink (for the other surface) transferred onto the surface (the other surface) of the paper sheet 1 on the outer side in the radial direction of the drying cylinder 132 is dried by the drying devices 134. The leading end-side of the paper sheet 1 is then gripped by the gripping devices 141*a* of the impression cylinder 141, so that the paper sheet 1 is held and transported on the impression cylinder 141.

The paper sheet 1 held on the impression cylinder 141 passes through the contact position of the impression cylinder 141 with the numbering cylinder 142, so that the number (for one surface) of the numbering cylinder 142 is printed on the surface (one surface) of the paper sheet 1 on the outer side in the radial direction of the impression cylinder 141 while the paper sheet 1 is pressed against the impression cylinder 141 by the sheet guide. At this time, since the ink (for one surface) offset-printed on the paper sheet 1 has been dried by the drying devices 133, the ink does not adhere to the sheet aside.

After the numbering printing is performed on the paper sheet 1 on the impression cylinder 141, the leading end-side of the paper sheet 1 is then gripped by the gripping devices 143*a* of the impression cylinder 143, so that the paper sheet 1 is held and transported on the impression cylinder 143. Since the numbering cylinder 144 is away from the impression cylinder 143, the paper sheet 1 held on the impression cylinder 143 is transported as it is with no numbering printing being performed on the surface (the other surface) of the paper sheet 1 on the outer side in the radial direction of the impression cylinder 143.

When the paper sheet 1 is held on the impression cylinder 143, the leading end-side of the paper sheet 1 is then gripped by the gripping devices 151*a* of the drying cylinder 151, so that the paper sheet 1 is held and transported on the drying cylinder 151. When the paper sheet 1 is held on the drying cylinder 151, the number (for one surface) printed on the surface (one surface) of the paper sheet 1 on the outer side in the radial direction of the drying cylinder 151 is dried by the drying devices 153. The leading end-side of the paper sheet 1 is then gripped by the gripping device 145*a* of the impression cylinder 145, so that the paper sheet 1 is held and transported on the impression cylinder 145.

The paper sheet 1 held on the impression cylinder 145 passes through the contact position of the impression cylinder 145 with the numbering cylinder 146, so that the number (for the other surface) of the numbering cylinder 146 is printed on the surface (the other surface) of the paper sheet 1 on the outer side in the radial direction of the impression cylinder 145 while the paper sheet 1 is pressed against the impression cylinder 143 by the sheet guide. At this time, since the ink (for the other surface) offset-printed on the paper sheet 1 has been dried by the drying devices 134, the ink does not adhere to the sheet guide.

After the numbering printing is performed on the paper sheet 1 on the impression cylinder 145, the leading end-side of the paper sheet 1 is then gripped by the gripping devices 161*a* of the transfer cylinder 161, so that the paper sheet 1 is held and transported on the transfer cylinder 161. The paper sheet 1 held on the transfer cylinder 161 is transported, and the leading end-side of the paper sheet 1 is then gripped by the gripping devices 152*a* of the drying cylinder 152, so that the paper sheet 1 is held and transported on the drying cylinder 152.

When the paper sheet 1 is held on the drying cylinder 152, the number (for the other surface) printed on the surface (the other surface) of the paper sheet 1 on the outer side in the radial direction of the drying cylinder 152 is dried by the drying devices 154. The leading end-side of the paper sheet 1 is then gripped by the gripping devices 162*a* of the transfer cylinder 162, so that the paper sheet 1 is held and transported on the transfer cylinder 162.

In the same manner as described above, the leading end-side of the paper sheet 1 held on the transfer cylinder 162 is then gripped by the gripping devices 163*a* of the transfer cylinder 163, so that the paper sheet 1 is held and transported on the transfer cylinder 163, and the leading end-side of the paper sheet 1 is then gripped by the gripper bar 185 of the delivery chain 184 through the delivery cylinder 181 of the delivery device 180. The paper sheet 1 is then transported in accordance with the traveling of the delivery chain 184, and discharged and piled on the delivery tray 186A or 186B.

As a result, offset printing of one type (one color) and numbering printing of one number are performed on both surfaces (the one surface and the other surface) of the paper sheet 1.

Accordingly, the printing press 100 according to the embodiment is not only capable of performing offset printing of two types (two colors) and numbering printing of two numbers on one surface (the other surface) of the paper sheet 1 by passing the paper sheet 1 therethrough only once, but also capable of performing offset printing of one type (one color) and numbering printing of one number on both surfaces (one surface and the other surface) of the paper sheet 1 by passing the paper sheet 1 therethrough only once. It is thus possible to significantly reduce the deterioration in registration accuracy between offset printing and numbering printing on one surface and offset printing and numbering printing on the other surface.

Therefore, According to the printing press 100 of the embodiment, it is possible not only to perform offset printing and numbering printing on only one surface of the paper sheet 1, but also to perform offset printing and numbering printing on both surfaces of the paper sheet 1 with high accuracy, In addition, it is possible to select offset printing of one color or two on one surface of the paper sheet 1, numbering printing of one number or two on one surface of the paper sheet 1, offset printing on both surfaces of the paper sheet 1, or numbering printing on both surfaces of the paper sheet 1, as desired. Therefore, printing with various specifications can be performed by passing the paper sheet 1 through the printing press only once.

In addition, since the transfer of the paper sheet 1 between the sheet feeding device 110 end the delivery device 180 is performed by only the cylinders, it is possible to largely reduce deterioration in the registration accuracy during the transfer of the paper sheet 1, and thus to greatly suppress deterioration in the accuracy of offset printing and numbering printing.

In addition, when numbering printing is performed on both surfaces of the paper sheet 1, numbering printing is first performed on one surface of the paper sheet 1 by the numbering printing unit for one surface. The number on the one surface of the paper sheet 1 is then dried by the drying unit for numbering printing for one surface while numbering printing is not performed on the other surface of the paper sheet 1 by the first numbering printing unit for the other surface. Thereafter, numbering printing is performed on the other surface of the paper sheet 1 by the second numbering printing unit for the other surface. Accordingly, it is possible to prevent smear and the like from occurring even when numbers are printed on one surface and the other surface of the paper sheet 1 at the same position in a direction perpendicular to the sheet face.

<Other Embodiments>

In the above-described embodiment, offset printing of one type (one color) is performed on both surfaces of the paper sheet 1 by the offset printing unit for one surface and the second offset printing unit for the other surface. However, in another embodiment, offset printing can be performed on both surfaces of the paper sheet 1 by the offset printing unit for one surface and the first offset printing unit for the other surface, for example.

In addition, in the above-described embodiment, the printing press in which the numbering and imprinting machine is combined with the offset printing machine is described. However, the present invention is not limited to this case, but can achieve the same operations and effects as those of the above-described embodiment even in the case of a numbering and imprinting machine combined with no offset printing machine.

INDUSTRIAL APPLICABILITY

The numbering and imprinting machine according to the present invention and the printing press utilizing the same can easily perform numbering printing on both surfaces of a sheet with high accuracy, and thus can be utilized very beneficially in the printing industry and the like.

REFERENCE SIGNS LIST

1 PAPER SHEET
100 PRINTING PRESS
110 SHEET FEEDING DEVICE
111 SHEET FEEDING TRAY
112 FEEDER BOARD
113 SWING ARM SHAFT PREGRIPPER
114 TRANSFER CYLINDER
121, 124, 127 IMPRESSION CYLINDER
121*a*, 124, 127*a* GPIPPING DEVICE
122, 125, 128 BLANKET CYLINDER
123, 126, 129 PLATE CYLINDER
131, 132 DRYING CYLINDER
133, 134 DRYING DEVICE
141, 143, 145 IMPRESSION CYLINDER
141*a*, 143*a*, 145*a* GRIPPING DEVICE
142, 144, 146 NUMBERING CYLINDER
151, 152 DRYING CYLINDER
153, 154 DRYING DEVICE

161 to 163 TRANSFER CYLINDER
161*a* TO 163*a* GRIPPING DEVICE
180 DELIVERY DEVICE
181 DELIVERY CYLINDER
183 SPROCKET
184 DELIVERY CHAIN
185 GRIPPER BAR
186A, 186B DELIVERY TRAY

The invention claimed is:

1. A numbering and imprinting machine for printing numbers on a sheet, comprising:

a numbering printing unit for one surface including an impression cylinder for numbering printing for one surface configured to hold and transport the sheet, and a numbering cylinder for one surface disposed to be movable into contact with and away from the impression cylinder for numbering printing for one surface, and configured to perform numbering printing on a surface of the sheet on an outer side in a radial direction of the impression cylinder for numbering printing for one surface while the sheet is held on the impression cylinder for numbering printing for one surface;

a first numbering printing unit for the other surface including a first impression cylinder for numbering printing for the other surface disposed in contact with the impression cylinder for numbering printing for one surface of the numbering printing unit for one surface at a position downstream of a contact position of the impression cylinder for numbering printing for one surface with the numbering cylinder for one surface in a sheet transport direction, and configured to receive the sheet from the impression cylinder for numbering printing for one surface and to hold and transport the sheet, and a first numbering cylinder for the other surface disposed to be movable into contact with and away from the first impression cylinder for numbering printing for the other surface, and configured to perform numbering printing on a surface of the sheet on an outer side in a radial direction of the first impression cylinder for numbering printing for the other surface while the sheet is held on the first impression cylinder for numbering printing for the other surface;

a drying unit for numbering printing for one surface including a drying cylinder for numbering printing for one surface disposed in contact with the first impression cylinder for numbering printing for the other surface of the first numbering printing unit for the other surface at a position downstream of a contact position of the first impression cylinder for numbering printing for the other surface with the first numbering cylinder for the other surface in the sheet transport direction, and configured to receive the sheet from the first impression cylinder for numbering printing for the other surface and to hold and transport the sheet, and drying means for numbering printing for one surface for drying a number printed on the surface of the sheet on an outer side in a radial direction of the drying cylinder for numbering printing for one surface while the sheet is held on the drying cylinder for numbering printing for one surface; and a second numbering printing unit for the other surface including a second impression cylinder for numbering printing for the other surface disposed in contact with the drying cylinder for numbering printing for one surface of the drying unit for numbering printing for one surface at a position downstream of a position where the drying means for numbering printing for one surface performs the drying, in the sheet transport direction, and configured to receive the sheet from the drying cylinder for numbering printing for one surface and to hold and transport the sheet, and a second numbering cylinder for the other surface disposed to be movable into contact with and away from the second impression cylinder for numbering printing for the other surface, and configured to perform numbering printing on the surface of the sheet on an outer side in a radial direction of the second impression cylinder for numbering printing for the other surface while the sheet is held on the second impression cylinder for numbering printing for the other surface, wherein numbering printing is enabled to be performed on both surfaces of the sheet when the impression cylinder for numbering printing for one surface and the numbering cylinder for one surface of the numbering printing unit for one surface are in contact with each other, the first impression cylinder for numbering printing for the other surface and the first numbering cylinder for the other surface of the first numbering printing unit for the other surface are away from each other, as well as the second impression cylinder for numbering printing for the other surface and the second numbering cylinder for the other surface of the second numbering printing unit for the other surface are in contact with each other, and numbering printing is enabled to be performed on only the other surface of the sheet when the impression cylinder for numbering printing for one surface and the numbering cylinder for one surface of the numbering printing unit for one surface are away from each other, the first impression cylinder for numbering printing for the other surface and the first numbering cylinder for the other surface of the first numbering printing unit for the other surface are in contact with each other, as well as the second impression cylinder for numbering printing for the other surface and the second numbering cylinder for the other surface of the second numbering printing unit for the other surface are in contact with each other.

2. The numbering and imprinting machine according to claim 1, further comprising:

an intermediate transport cylinder for numbering printing disposed in contact with the second impression cylinder for numbering printing for the other surface of the second numbering printing unit for the other surface at a position downstream of a contact position of the second impression cylinder for numbering printing for the other surface with the second numbering cylinder for the other surface in the sheet transport direction, and configured to receive the sheet from the second impression cylinder for numbering printing for the other surface and to hold and transport the sheet; and a drying unit for numbering printing for the other surface including a drying cylinder for numbering printing for the other surface disposed in contact with the intermediate transport cylinder for numbering printing, and configured to receive the sheet from the intermediate transport cylinder for numbering printing and to hold and transport the sheet, and drying means for numbering printing for the other surface for drying a number printed on the surface of the sheet on an outer side in a radial direction of the drying cylinder for numbering printing for the other surface while the sheet is held on the drying cylinder for numbering printing for the other surface.

3. A printing press comprising:

the numbering and imprinting machine according to claim 1; and an offset printing machine disposed at a position upstream of the impression cylinder for numbering printing for one surface of the numbering printing unit for one surface of the numbering and imprinting machine in the sheet transport direction, and configured to perform offset printing on the sheet.

4. The printing press according to claim 3, wherein the offset printing machine includes:

an offset printing unit for one surface including an impression cylinder for offset printing for one surface configured to hold and transport the sheet, a blanket cylinder for one surface disposed in contact with the impression cylinder for offset printing for one surface, and a plate cylinder for one surface disposed in contact with the blanket cylinder for one surface;

a first offset printing unit for the other surface including a first impression cylinder for offset printing for the other surface disposed in contact with the impression cylinder for offset printing for one surface of the offset printing unit for one surface at a position downstream of a contact position of the impression cylinder for offset printing for one surface with the blanket cylinder for one surface in the sheet transport direction, and configured to receive the sheet from the impression cylinder for offset printing for one surface and to hold and transport the sheet, a first blanket cylinder for the other surface disposed in contact with the first impression cylinder for offset printing for the other surface, and a first plate cylinder for the other surface disposed in contact with the first blanket cylinder for the other surface;

a drying unit for offset printing for one surface including a drying cylinder for offset printing for one surface disposed in contact with the first impression cylinder for offset printing for the other surface of the first offset printing unit for the other surface at a position downstream of a contact position of the first impression cylinder for offset printing for the other surface with the first blanket cylinder for the other surface in the sheet transport direction, and configured to receive the sheet from the first impression cylinder for offset printing for the other surface and to hold and transport the sheet, and drying means for offset printing for one surface for drying an ink transferred on the surface of the sheet on an outer side in a radial direction of the drying cylinder for offset printing for one surface while the sheet is held on the drying cylinder for offset printing for one surface; and a drying unit for offset printing for the other surface including a drying cylinder for offset printing for the other surface disposed in contact with the drying cylinder for offset printing for one surface of the drying unit for offset printing for one surface at a position downstream of a position where the drying means for offset printing for one surface performs the drying, in the sheet transport direction, and configured to receive the sheet from the impression cylinder for offset printing for one surface and to hold and transport the sheet, and drying means for offset printing for the other surface for drying an ink transferred on the surface of the sheet on an outer side in a radial direction of the drying cylinder for offset printing for the other surface while the sheet is held on the drying cylinder for offset printing for the other surface.

5. The printing press according to claim 4, wherein the offset printing machine includes a second offset printing unit for the other surface including a second impression cylinder for offset printing for the other surface disposed in contact with the impression cylinder for offset printing for one surface of the offset printing unit for one surface at a position upstream of a contact position of the impression cylinder for offset printing for one surface with the blanket cylinder for one surface in the sheet transport direction, and configured to hold the sheet and transport the sheet to the impression cylinder for offset printing for one surface, a second blanket cylinder for the other surface disposed in contact with the second impression cylinder for offset printing for the other surface at a position upstream of a contact position of the second impression cylinder for offset printing for the other surface with the impression cylinder for offset printing for one surface in the sheet transport direction, and a second plate cylinder for the other surface disposed in contact with the second blanket cylinder for the other surface.

6. The printing press according to claim 4, wherein the drying cylinder for offset printing for the other surface of the drying unit for offset printing for the other surface of the offset printing machine is in contact with the impression cylinder for numbering printing for one surface of the numbering printing unit for one surface of the numbering and imprinting machine at a position upstream of a contact position of the impression cylinder for numbering printing for one surface with the numbering cylinder for one surface in the sheet transport direction.

* * * * *